US010429770B2

(12) United States Patent
Kumiya et al.

(10) Patent No.: US 10,429,770 B2
(45) Date of Patent: Oct. 1, 2019

(54) POWDER-AMOUNT DETECTION DEVICE AND IMAGE FORMING APPARATUS INCORPORATING SAME

(71) Applicants: Taku Kumiya, Kanagawa (JP); Masahide Yamashita, Tokyo (JP); Yohei Kushida, Hyogo (JP); Takuya Murata, Tokyo (JP); Keita Maejima, Kanagawa (JP)

(72) Inventors: Taku Kumiya, Kanagawa (JP); Masahide Yamashita, Tokyo (JP); Yohei Kushida, Hyogo (JP); Takuya Murata, Tokyo (JP); Keita Maejima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/996,593

(22) Filed: Jun. 4, 2018

(65) Prior Publication Data

US 2018/0348673 A1 Dec. 6, 2018

(30) Foreign Application Priority Data

Jun. 5, 2017 (JP) ..... 2017-110794

(51) Int. Cl.
*G03G 15/08* (2006.01)
*G03G 15/16* (2006.01)
(Continued)

(52) U.S. Cl.
CPC ..... *G03G 15/162* (2013.01); *B65H 5/025* (2013.01); *G03G 15/0851* (2013.01);
(Continued)

(58) Field of Classification Search
CPC ..... G03G 15/162; G03G 15/161; G03G 2215/1661; B65H 5/025
See application file for complete search history.

(56) References Cited

U.S. PATENT DOCUMENTS 5,655,199 A 8/1997 Yamashita et al.
5,761,594 A 6/1998 Seto et al.
(Continued)

FOREIGN PATENT DOCUMENTS

JP 2004-286792 10/2004
JP 2004-286793 10/2004
JP 2009-116120 5/2009

OTHER PUBLICATIONS

U.S. Appl. No. 08/639,961, filed Apr. 29, 1996, Jun Aoto, et al.
U.S. Appl. No. 09/033,643, filed Mar. 3, 1998, Mitsuru Seto, et al.

*Primary Examiner* — David M. Gray
*Assistant Examiner* — Michael A Harrison
(74) *Attorney, Agent, or Firm* — Harness, Dickey & Pierce, P.L.C.

(57) ABSTRACT

A powder-amount detection device includes an outer electrode, an inner electrode, and a detector. The outer electrode is disposed outside a powder container to be replaceably installed to an image forming apparatus. The inner electrode is disposed inside a powder supply port of the powder container. The detector is configured to apply an electric field between the outer electrode and the inner electrode to detect a capacitance between the outer electrode and the inner electrode.

11 Claims, 5 Drawing Sheets

(51) Int. Cl.
*B65H 5/02* (2006.01)
*G03G 15/00* (2006.01)

(52) U.S. Cl.
CPC ..... *G03G 15/161* (2013.01); *G03G 15/556* (2013.01); *G03G 2215/1661* (2013.01)

(56) References Cited

U.S. PATENT DOCUMENTS

| | | | | |
|---|---|---|---|---|
| 5,774,775 | A | 6/1998 | Aoto et al. | |
| 2016/0131990 | A1* | 5/2016 | Kanazawa | G03G 15/086 399/27 |
| 2016/0320724 | A1* | 11/2016 | Ishido | G03G 15/0865 |
| 2018/0039221 | A1 | 2/2018 | Nakamoto et al. | |

* cited by examiner

POWDER-AMOUNT DETECTION DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2017-110794, filed on Jun. 5, 2017, in the Japan Patent Office, the entire disclosure of which is hereby incorporated by reference herein.

BACKGROUND

Technical Field

Aspects of the present disclosure relate to a powder-amount detection device and an image forming apparatus to detect the amount of powder in a powder container.

Related Art

Typically, an electrophotographic image forming apparatus includes a replaceable toner bottle to replenish toner for image formation. To reduce the user's downtime caused by the replacement of toner bottles, various devices have been proposed to detect the amount of toner in the toner bottle and grasp the bottle replacement timing beforehand.

SUMMARY

In an aspect of the present disclosure, there is provided a powder-amount detection device that includes an outer electrode, an inner electrode, and a detector. The outer electrode is disposed outside a powder container to be replaceably installed to an image forming apparatus. The inner electrode is disposed inside a powder supply port of the powder container. The detector is configured to apply an electric field between the outer electrode and the inner electrode to detect a capacitance between the outer electrode and the inner electrode.

In another aspect of the present disclosure, there is provided an image forming apparatus that includes an electrophotographic image forming unit, a powder container housing to house the powder container to supply powder to the electrophotographic image forming unit, and the powder-amount detection device disposed in the powder container housing.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
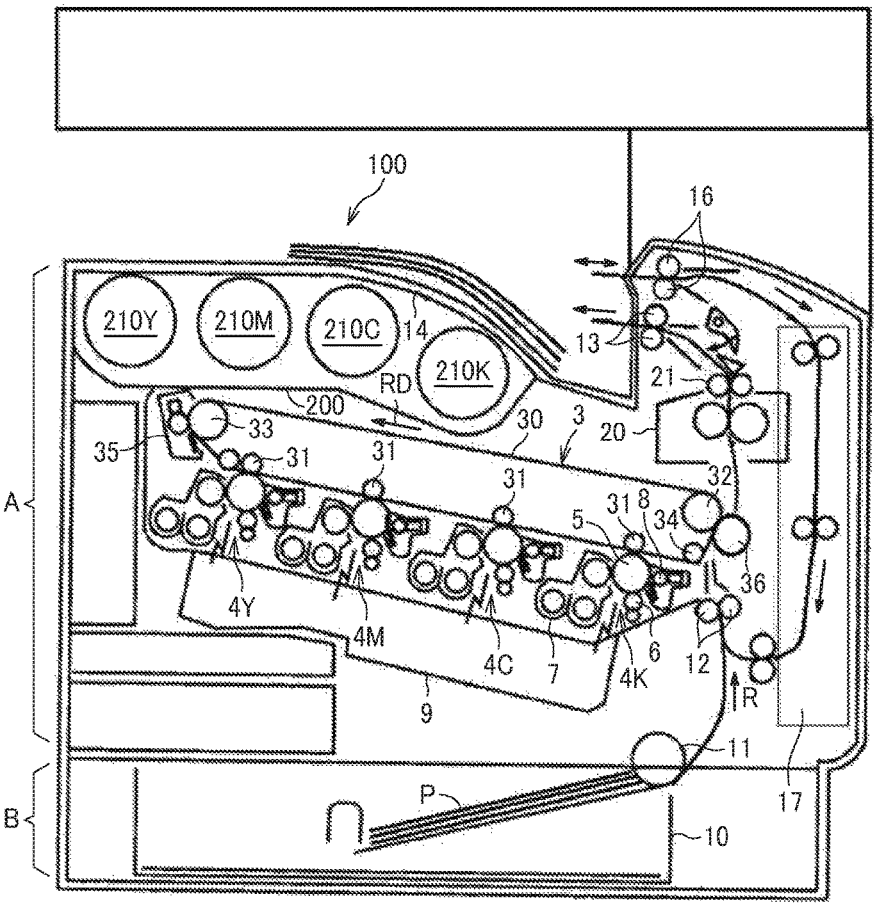
FIG. 1 is a schematic view of an image forming apparatus including a powder-amount detection device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, a powder-amount detection device according to an embodiment of the present disclosure and an image forming apparatus including the powder-amount detection device are described with reference to the drawings.

Image Forming Apparatus.

First, the overall configuration of the image forming apparatus according to an embodiment of the present disclosure is described below. An image forming apparatus 100 illustrated in FIG. 1 is a color laser printer and includes, e.g., an image forming section A, a sheet feeding section B, a pair of sheet ejection rollers 13, a sheet ejection tray 14, a fixing device 20, and a curl correcting device 21. The image forming section A includes, e.g., four image forming units 4Y, 4M, 4C, and 4K, which are described later, an exposure device 9, and a transfer device 3. A further description is given below of the image forming section A.

In a middle of an image forming apparatus body of the image forming apparatus 100, four image forming units 4Y, 4M, 4C, and 4K are disposed. The image forming units 4Y, 4M, 4C, and 4K have the same configuration except for accommodating developers of different colors of yellow (Y), magenta (M), cyan (C), and black (K) corresponding to color separation components of a color image.

For example, each of the image forming units 4Y, 4M, 4C, and 4K includes a drum-shaped photoconductor 5 as a latent image bearer, a charging device 6 to charge a surface of the photoconductor 5, a developing device 7 to supply toner as powder, and a cleaning device 8 to clean the surface of the photoconductor 5.

In FIG. 1, the photoconductor 5, the charging device 6, the developing device 7, and the cleaning device 8 included in the image forming unit 4K for black are denoted by reference numerals. The other image forming units 4Y, 4M, and 4C have the same structure as the image forming unit 4K for black.

The exposure device 9 to expose the surface of each photoconductor 5 is disposed below each of the image forming units 4Y, 4M, 4C, and 4K. The exposure device 9 includes, e.g., a laser light source, a polygon mirror, an f-θ lens, a plurality of reflection mirrors and irradiates the surface of each photoconductor 5 with a laser beam according to image data, thus forming an electrostatic latent image on the surface of each photoconductor 5.

The transfer device 3 is disposed above each of the image forming units 4Y, 4M, 4C, and 4K. The transfer device 3 includes an intermediate transfer belt 30 as an intermediate transfer member, four primary transfer rollers 31 as primary transfer members, a secondary transfer roller 36 as a secondary transfer member, a secondary transfer backup roller 32, a cleaning backup roller 33, a tension roller 34, and a belt cleaning device 35.

The intermediate transfer belt 30 is an endless belt, and is stretched taut by the secondary transfer backup roller 32, the cleaning backup roller 33, and the tension roller 34. Here, as the secondary transfer backup roller 32 is driven to rotate, the intermediate transfer belt 30 circulates (rotates) in a direction indicated by arrow RD in FIG. 1.

Each of the four primary transfer rollers 31 sandwiches the intermediate transfer belt 30 with each photoconductor 5, to form a primary transfer nip. A power supply is connected to each of the primary transfer rollers 31 so that a predetermined direct current (DC) voltage or a predetermined alternating current (AC) voltage is applied to each primary transfer roller 31.

The secondary transfer roller 36 sandwiches the intermediate transfer belt 30 with the secondary transfer backup roller 32, to form a secondary transfer nip. Similarly with the primary transfer roller 31, a power supply is also connected to the secondary transfer roller 36 so that a predetermined DC voltage or AC voltage is applied to the secondary transfer roller 36.

The belt cleaning device 35 includes a cleaning brush and a cleaning blade that are disposed so as to contact the intermediate transfer belt 30. Waste toner collected by the belt cleaning device 35 is accommodated in a waste toner container via a waste toner drain tube.

At an upper part of the image forming apparatus body, a bottle housing 200 is disposed. In the bottle housing 200, four toner bottles 210Y, 210M, 210C, and 210K as powder containers to store replenishment toner are replaceably mounted. Toner as powder is supplied from each of the toner bottles 210Y, 210M, 210C, and 210K to each developing device 7 via a replenishment path disposed between each of the toner bottles 210Y, 210M, 210C, 210K and each developing device 7. At outlet portions of the toner bottles 210Y, 210M, 210C, and 210K, a toner-amount detection device 250 as a powder-amount detection device is disposed. The toner-amount detection device 250 is described later with reference to FIGS. 2A through 5B.

On the other hand, at a lower part of the image forming apparatus body of the image forming apparatus 100, the sheet feeding section B is disposed. The sheet feeding section B includes, e.g., a sheet feed tray 10 to accommodate recording media P as sheet-shaped materials (recording media) and a sheet feed roller 11 to feed the recording media P from the sheet feed tray 10.

Examples of the recording media P include thick paper, postcards, envelopes, thin paper, coated paper (or art paper), tracing paper, and OHP sheets, in addition to plain paper. The image forming apparatus 100 may further include a bypass sheet feeding mechanism. In the present embodiment, "thick paper" means paper having a basis weight of 160 g/m$^2$ or more.

In the image forming apparatus body, a conveyance path R to eject the recording medium P from the sheet feed tray 10 through the secondary transfer nip to the outside of the image forming apparatus 100. On the conveyance path R, a pair of registration rollers 12 as timing rollers to convey the recording medium P to the secondary transfer nip at proper conveyance timing is disposed at an upstream side from the position of the secondary transfer roller 36 in a conveyance direction of the recording medium P.

Further, on a downstream side from the position of the secondary transfer roller 36 in the conveyance direction of the recording medium P, the fixing device 20 is disposed that presses and heats the recording medium P bearing an unfixed toner image to fix the toner image on the recording medium P. A pair of sheet ejection rollers 13 to eject the recording medium P to the outside of the image forming apparatus 100 is disposed on the downstream side from the fixing device 20 in the conveyance direction of the recording medium P on the conveyance path R. The sheet ejection tray 14 to stock the recording medium P ejected outside the image forming apparatus 100 is disposed on an upper surface of the image forming apparatus body.

Basic Operation of Image Forming Apparatus.

Next, a basic operation of the image forming apparatus 100 according to the present embodiment is described. First, when image forming operation is started, each photoconductor 5 in each of the image forming units 4Y, 4M, 4C, and 4K is driven to rotate clockwise in FIG. 1, and the surface of each photoconductor 5 is uniformly charged by the charging device 6 to a predetermined polarity. The surface of each charged photoconductor 5 is irradiated laser light from the exposure device 9 and an electrostatic latent image is formed on the surface of each photoconductor 5.

Here, image data to be exposed on each photoconductor 5 is monochromatic image data obtained by decomposing a full-color image into color data of yellow, magenta, cyan and black. As toner is supplied to the electrostatic latent image formed on each photoconductor 5 by each developing device 7, the electrostatic latent image is visualized as an image.

When the image forming operation is started, the secondary transfer backup roller 32 is driven to rotate counterclockwise in FIG. 1, thus causing the intermediate transfer belt 30 to travel around in the direction indicated by arrow RD in FIG. 1. In addition, as a constant voltage or a constant-current-controlled voltage having a polarity opposite to the charging polarity of the toner is applied to each primary transfer roller 31, A transfer electric field is formed in the primary transfer nip between each primary transfer roller 31 and each photoconductor 5.

Then, when the image of the corresponding color on each photoconductor 5 reaches the primary transfer nip with the rotation of each photoconductor 5, the image on each photoconductor 5 is sequentially transferred onto the intermediate transfer belt 30 in a superimposed manner by action of the transfer electric field formed at the primary transfer nip.

Thus, a full-color image is borne on the surface of the intermediate transfer belt 30. Toner on each photoconductor 5 that has not been transferred to the intermediate transfer belt 30 is removed by the cleaning device 8. The surface of each photoconductor 5 is neutralized by a neutralizing device, and the surface potential is initialized.

In a lower portion of the image forming apparatus 100, the sheet feed roller 11 starts to rotate, and the recording medium P is sent out from the sheet feed tray 10 to the conveyance path R. The conveyance of the recording medium P fed to the conveyance path R is temporarily stopped by the pair of registration rollers 12.

Then, the pair of registration roller 12 starts to rotate at a predetermined timing, and the recording medium P is conveyed to the secondary transfer nip at the timing when the images on the intermediate transfer belt 30 reaches the secondary transfer nip. At this time, the secondary transfer roller 36 is applied with a transfer voltage having the polarity opposite to the charging polarity of toner of the images on the intermediate transfer belt 30, thus forming a transfer electric field in the secondary transfer nip.

By the transfer electric field, the images on the intermediate transfer belt 30 are collectively transferred onto the recording medium P. Residual toner on the intermediate transfer belt 30 that has not been transferred to the recording medium P is removed by the belt cleaning device 35 and drained to the waste toner container.

Then, the recording medium P is conveyed to the fixing device 20, and the images on the recording medium P are fixed on the recording medium P by the fixing device 20. The recording medium P conveyed from the fixing device 20 passes through the curl correcting device 21 and is ejected onto the sheet ejection tray 14 outside the image forming apparatus body.

Although the above-described description is about the image forming operation performed when a full color image is formed on the recording medium P, the image forming apparatus 100 can form a single color image using any one of the four image forming units 4Y, 4M, 4C, and 4K or form images of two or three colors using any two or three of the image forming units 4Y, 4M, 4C, and 4K.

Toner-Amount Detection Device.

Figure 2B:
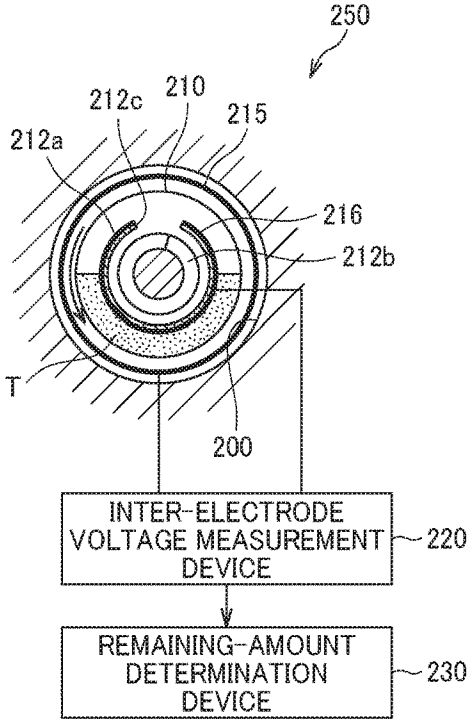
FIG. 2B is a cross-sectional view of the powder-amount detection device cut along line b-b of FIG. 2A.
Figure 2A:
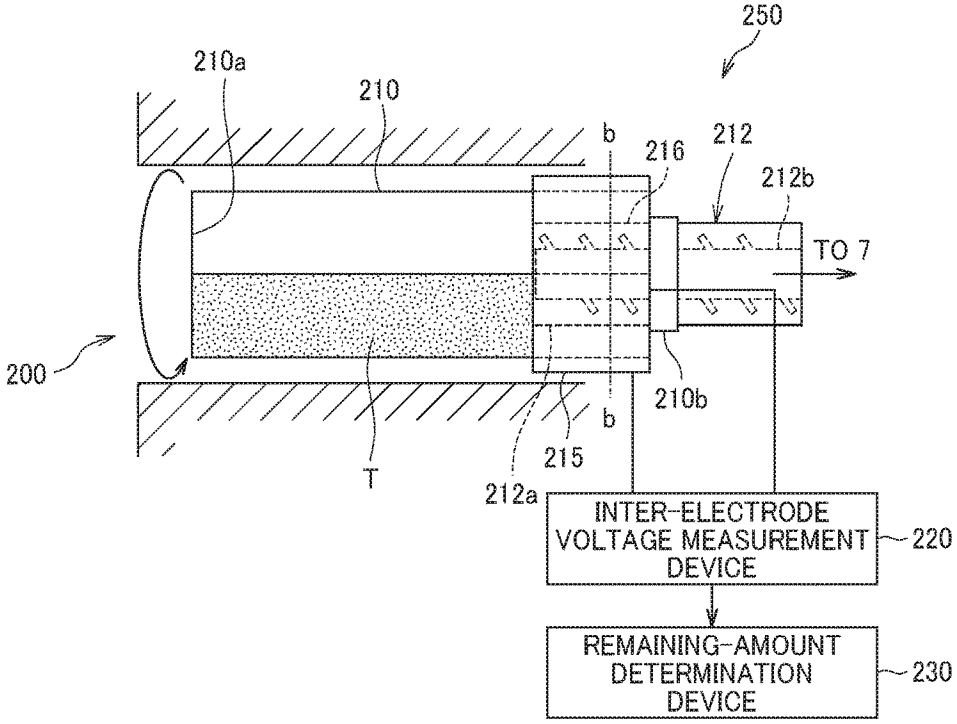
FIG. 2A is a side view of a powder-amount detection device according to an embodiment of the present disclosure.

Next, the toner-amount detection device 250 to detect the amount of toner in the toner bottle 210 is described. As illustrated in FIGS. 2A and 2B, the toner bottle 210 is molded in a cylindrical shape and accommodates the toner T in the toner bottle 210. The toner bottle 210 has a bottom portion 210*a* on one end side and a circular toner supply port 210*b* as a powder supply port on the other end side.

The axis of the toner supply port 210*b* is the same as the axis of the toner bottle 210, and the toner bottle 210 is rotationally symmetrical as a whole. A spiral rib or groove is formed on an inner circumferential surface of the toner bottle 210 so that toner T can be moved toward the toner supply port 210*b* by the rotation of the toner bottle 210.

The toner bottle 210 illustrated in FIG. 2A is horizontally inserted into the bottle housing 200 of the image forming apparatus 100 with the toner supply port 210*b* directed toward the bottle housing 200 and rightward in FIG. 2A. A driving device to intermittently rotate the toner bottle 210 in one direction about the axis of the toner bottle 210 is disposed in the bottle housing 200. By the intermittent rotation and the action of the spiral rib or groove, the toner T in the toner bottle 210 is moved rightward, that is, toward the toner supply port 210*b*.

A cylindrical toner conveyance unit 212 as a powder conveyance unit is horizontally fixed and arranged coaxially with the horizontally-set toner bottle 210 on the back side of the bottle housing 200. The toner conveyance unit 212 includes a cylindrical guide portion 212*a* and a conveyance screw 212*b*. The conveyance screw 212*b* as a powder conveyor is rotatably housed in the cylindrical guide portion 212*a* and extends to a leading end portion of the cylindrical guide portion 212*a*. An upper wall of the leading end portion of the cylindrical guide portion 212*a* is cut out by a predetermined length in the axial direction to be a toner supply port 212*c*.

An inner electrode 216 is disposed on an outer circumferential surface of the cylindrical guide portion 212*a* of the toner conveyance unit 212. The inner electrode 216 can be formed by molding a sheet-shaped conductive metal into a cylindrical shape and adhering the molded metal to the outer circumferential surface of the cylindrical guide portion 212*a*. An outer electrode 215 is disposed on an outer periphery of the toner bottle 210 so as to be positioned radially outside the inner electrode 216.

The outer electrode 215 can also be formed by molding a sheet-shaped conductive metal into a cylindrical shape. The inner electrode 216 and the outer electrode 215 are parallel to the axis of the toner bottle 210 or the toner supply port 210*b*, so that the inner electrode 216 and the outer electrode 215 are also arranged coaxially and in parallel.

As illustrated in FIGS. 2A and 2B, an inter-electrode voltage measurement device 220 is connected to the inner electrode 216 and the outer electrode 215. The inter-electrode voltage measurement device 220 acts as a detector to apply an electric field between the inner electrode 216 and the outer electrode 215 to detect an electrostatic capacitance generated between the inner electrode 216 and the outer electrode 215.

The inter-electrode voltage measurement device 220 is connected to a remaining-amount determination device 230. The remaining-amount determination device 230 detects the amount of toner present between the inner electrode 216 and the outer electrode 215 from the magnitude of the capacitance between the inner electrode 216 and the outer electrode 215. The relationship between the magnitude of the capacitance and the toner amount can be obtained in advance by, e.g., experiments.

Figure 3A:
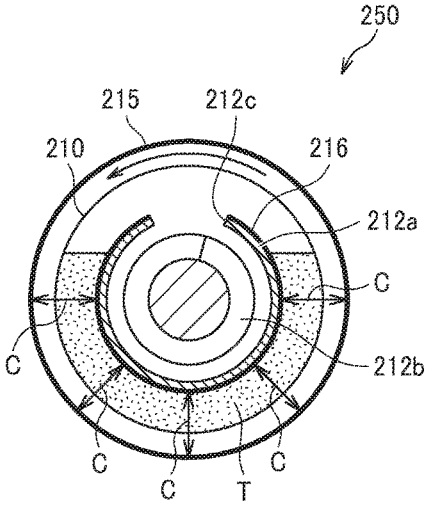
FIG. 3A is a cross-sectional view of a toner bottle containing a large amount of toner at the start of use.
Figure 3B:
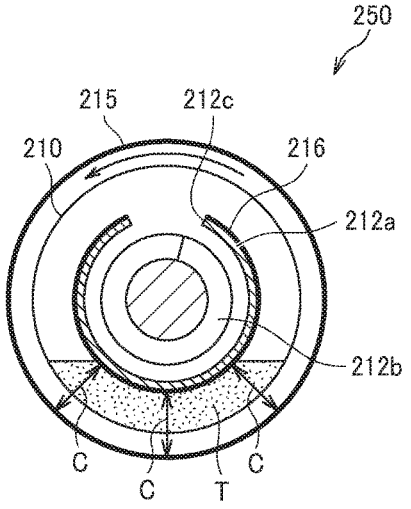
FIG. 3B is a cross-sectional view of the toner bottle containing a small amount of toner.

In FIG. 2A, the outer electrode 215 is annularly and continuously arranged over the entire circumference 360° of the outer circumferential surface of the toner bottle 210. However, in some embodiments, the outer electrode 215 may not be continuously arranged in an annular shape. At least, the outer electrode 215 is disposed near the bottom of the toner bottle 210 set horizontally as illustrated in FIGS. 3A and 3B. If the outer electrode 215 is disposed near the bottom, the amount of toner can be detected from the magnitude of the capacitance C between the outer electrode 215 and the inner electrode 216 even in a state in which the remaining amount of toner T is small as illustrated in FIG. 3B.

On the other hand, since there is no inner electrode at the portion of the toner supply port 212*c*, the outer electrode 215 may have a partially-cut-out shape in which a portion corresponding to the toner supply port 212*c* is partially cut out. For such a shape, the outer electrode 215 has a C-shaped cross section opened upward in FIG. 3A. The longer the shape of the outer electrode extends upward in the circumferential direction, the more accurately the change in toner amount can continuously be detected.

Figure 4A:
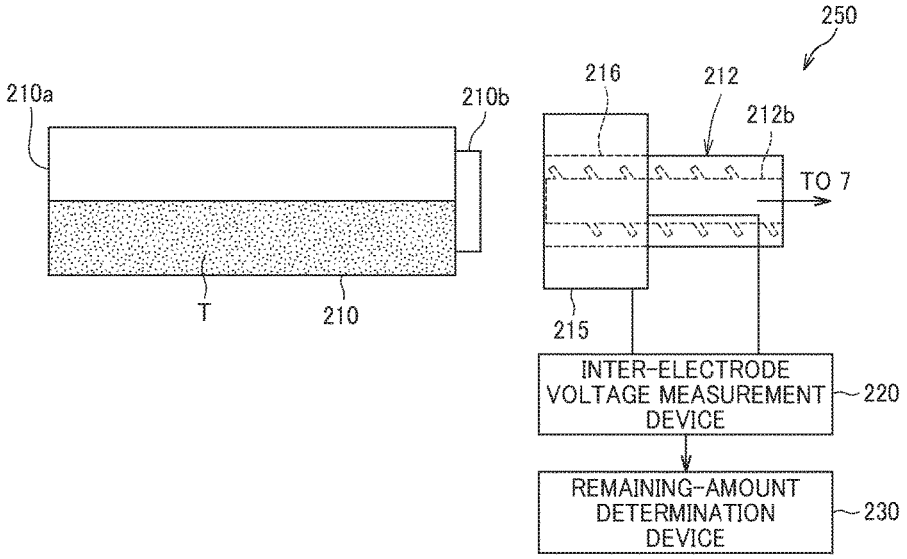
FIG. 4A is a schematic side view of a toner bottle and a toner conveyance unit in a case in which an outer electrode is disposed on an apparatus body of the image forming apparatus.
Figure 4B:
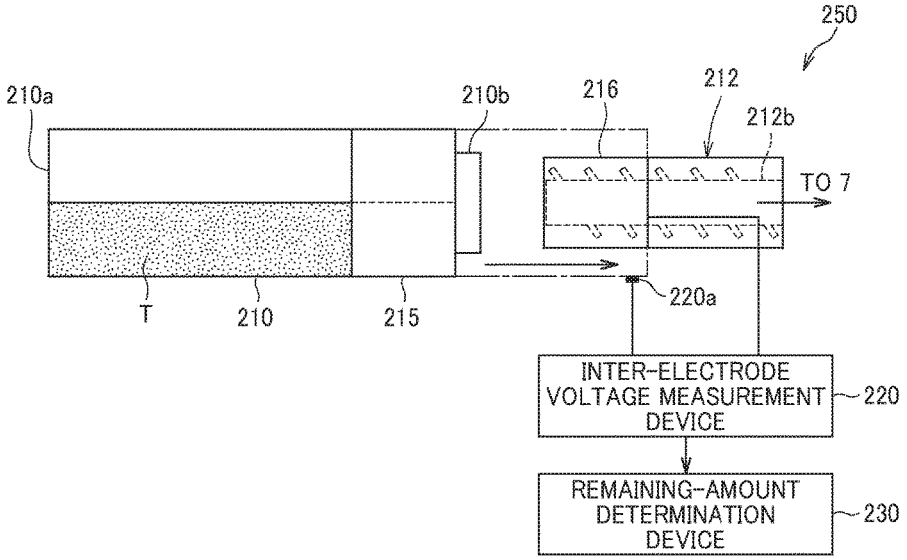
FIG. 4B is a schematic side view of a toner bottle and a toner conveyance unit in a case in which the outer electrode is disposed on the toner bottle.

The above-described outer electrode 215 can be disposed on an apparatus body side as illustrated in FIG. 4A or on a toner bottle side as illustrated in FIG. 4B. In both FIG. 4A and FIG. 4B, the outer electrode 215 has a continuous cylindrical shape in the circumferential direction.

When the outer electrode 215 is fixedly disposed on the apparatus body side as illustrated in FIG. 4A, a cost increase of the toner bottle 210 due to the outer electrode can be avoided. Regardless of replacement of the toner bottle 210, the distance between the outer electrode 215 and the inner electrode 216 can be maintained constant, thus preventing a detection error of the toner amount due to a variation of the distance between the outer electrode 215 and the inner electrode 216.

If the outer electrode 215 is disposed on the toner bottle side as illustrated in FIG. 4B, for example, the following advantages can be obtained: 1) the outer electrode 215 can be brought into close contact with the circumferential surface of the toner bottle, thus enhancing the detection accuracy of the toner amount, 2) the space of the bottle housing 200 can be more compact, and 3) there is no restriction on the rotational position of the toner bottle 210 when the toner bottle 210 is installed.

Further, even when the surface of the outer electrode 215 becomes dirty due to toner scattering or the like in the image forming apparatus, the outer electrode 215 can be replaced with replacement of the toner bottle 210. The connection between the outer electrode 215 and the inter-electrode voltage measurement device 220 can be secured by, for example, a contact point 220*a* at which the outer electrode 215 contacts the inter-electrode voltage measurement device 220 when the toner bottle 210 is installed.

As a method of attaching the outer electrode 215, for example, a method of integrally installing the outer electrode 215 on a display label, such as a part number to be affixed to the outer circumferential surface of the toner bottle 210, can be considered. Integrating the outer electrode 215 with the display label can omit the trouble of attaching the outer electrode 215.

Operation of Toner Amount Detection Device.

When the toner bottle 210 is inserted and set rightward in the bottle housing 200 in FIG. 2A, the cylindrical guide portion 212*a* of the toner conveyance unit 212 disposed on the back side of the bottle housing 200 is inserted into the toner bottle 210 of the toner supply port 210*b*. When the toner bottle 210 is intermittently rotated in such a state, the toner T is replenished to the toner supply port 212*c* of the toner conveyance unit 212.

That is, the toner T in the toner bottle 210 is gradually moved in the right direction in FIG. 2A by the action of the above-described spiral rib or groove while being wound up in the circumferential direction as the toner bottle 210 rotates. The toner T wound up in the circumferential direction near the toner supply port 210*b* drops inward from the toner supply port 212*c* at the upper part of the toner conveyance unit 212. At a position to which the toner T drops, a leading end portion of the conveyance screw 212*b* is positioned. The toner T is conveyed to the developing device 7 of the image forming apparatus 100 by the conveyance screw 212*b*.

As the toner T is conveyed to the outside of the toner bottle, the surface of the toner T in the toner bottle is lowered, and the remaining-amount determination device 230 detects a decrease in the amount of toner correspondingly. The inner electrode 216 is positioned on a leading end surface of the toner conveyance unit 212 on the apparatus body side and is inserted into the toner supply port 210*b* of the toner bottle 210 when the toner bottle 210 is installed to the bottle housing 200. Thus, the inner electrode 216 and the outer electrode 215 are arranged with the toner T sandwiched between the inner electrode 216 and the outer electrode 215. Such an electrode arrangement allows the toner amount to be accurately detected just before the toner runs out.

That is, when the amount of toner is large as illustrated in FIG. 3A, the capacitance C between the inner electrode 216 and the outer electrode 215 is large, so that the remaining-amount determination device 230 determines that the toner amount is large. When the amount of toner is small as illustrated in FIG. 3B, the capacitance C between the inner electrode 216 and the outer electrode 215 is small, the remaining-amount determination device 230 determines that the toner amount is small. Here, the outer electrode 215 and the inner electrode 216 are coaxially cylindrical and have the same central axis as the central axis of the toner bottle 210, thus allowing elimination of fluctuation of toner amount between the outer electrode 215 and the inner electrode 216 due to rotation of the toner bottle 210 for toner replenishment.

Near the toner supply port 210*b* of the toner bottle 210, the toner T always stays until just before the toner amount becomes zero. That is, even when the amount of toner becomes small and the toner T is completely absent on the side of the bottom portion 210*a* of the toner bottle 210, as illustrated in FIG. 3B, the toner T always exists between the outer electrode 215 and the inner electrode 216 near the toner supply port 210*b* until just before the toner amount becomes zero.

Therefore, the amount of toner can be accurately detected until just before the toner runs out, thus preventing the replacement timing of the toner bottle 210 from being too early or too late due to erroneous detection of the toner amount.

Figure 5B:
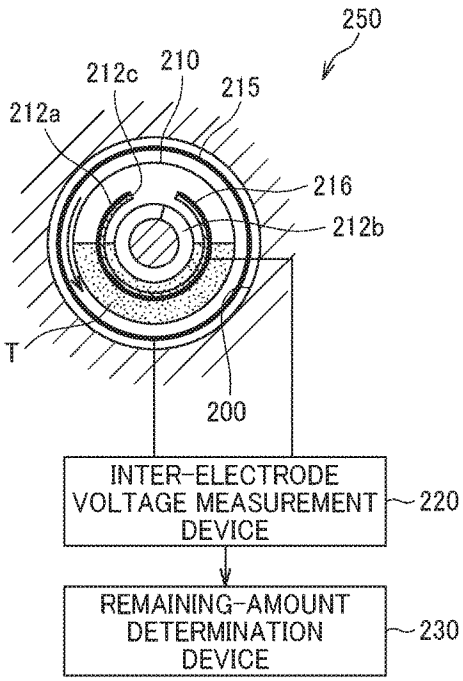
FIG. 5B is a cross-sectional view of the powder-amount detection device cut along line b-b of FIG. 5A.
Figure 5A:
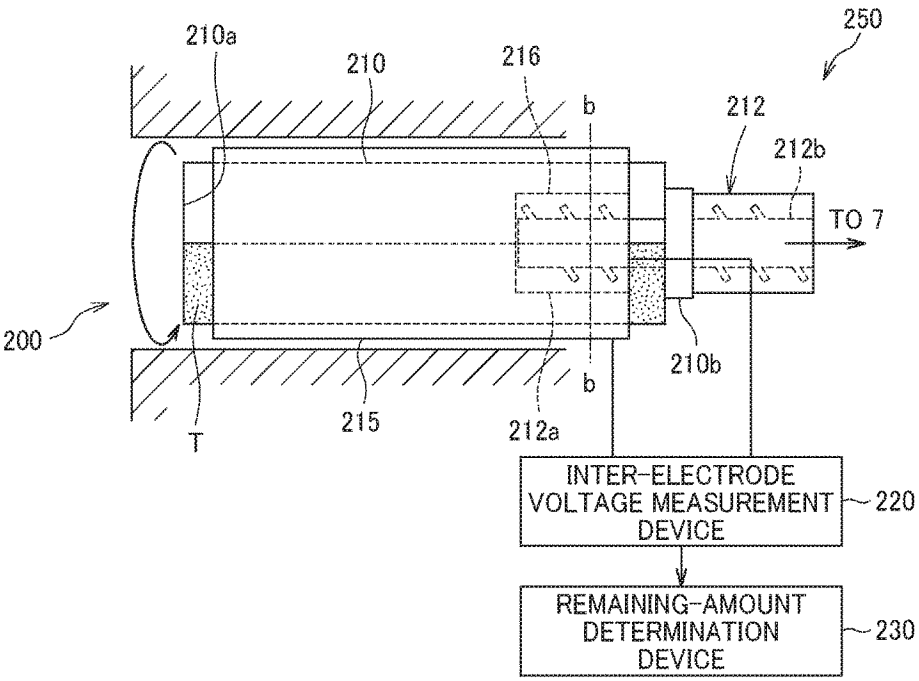
FIG. 5A is a side view of a modified embodiment of the powder-amount detection device in which an outer electrode is arranged from one end to the other end of a toner bottle.

In FIGS. 5A and 5B, the cylindrical outer electrode 215 elongated in the axial direction is disposed on an inner wall of the bottle housing 200. Almost all of the outer circumferential surface of the toner bottle 210 is covered with the outer electrode 215. The configuration illustrated in FIGS. 5A and 5B are the same as the configuration illustrated in FIGS. 2A and 2B except for the outer electrode 215.

In FIG. 5B, since almost all the outer circumferential surface of the toner bottle 210 is covered by the outer electrode 215, a decrease in toner amount can be continuously and accurately detected until the toner runs out from the start of use at which the toner amount of the toner bottle 210 is large. Accordingly, the bottle replacement time can more accurately be grasped, thus preventing occurrence of down time due to unexpected runout of toner. Similarly with the outer electrode 215 of FIG. 4B, the outer electrode 215 of FIG. 5B can also be integrally mounted on a display label, such as a part number to be affixed to the outer circumferential surface of the toner bottle 210.

Although some embodiments of the present disclosure have been described above, the present invention is not limited to the above-described embodiments, and various variations and modifications are possible within the scope of the technical idea described in the claims. For example, although the shapes of the toner bottle 210, the outer electrode 215, and the inner electrode 216 are cylindrical in the above-described embodiment, the shapes of the toner bottle 210, the outer electrode 215, and the inner electrode 216 are not limited to such cylindrical shapes and may be any suitable shapes as long as the outer electrode 215 and the inner electrode 216 can be arranged as described in appended claim 1.

What is claimed is:

1. A powder-amount detection device comprising:

an outer electrode outside a powder container, the powder container being replaceably installable in an image forming apparatus;

an inner electrode fixedly attached to the image forming apparatus, the inner electrode configured to be inserted inside a powder supply port of the powder container by installation of the powder container to the image forming apparatus; and a detector configured to apply an electric field between the outer electrode and the inner electrode to detect a capacitance between the outer electrode and the inner electrode.

2. The powder-amount detection device according to claim 1, wherein the powder container is cylindrical and the powder supply port is at one axial end of the powder container, and wherein the outer electrode is a first cylindrical electrode concentric with an axis of the powder container and is attached to the image forming apparatus.

3. The powder-amount detection device according to claim 2, wherein the inner electrode is a second cylindrical electrode concentric with the axis of the powder container.

4. The powder-amount detection device according to claim 2, wherein the outer electrode extends continuously from the powder supply port at the one axial end of the powder container to another axial end of the powder container.

5. The powder-amount detection device according to claim 1, wherein the outer electrode is on at least a portion of a surface of a display label on an outer circumferential surface of the powder container.

6. The powder-amount detection device according to claim 1, further comprising:

a powder conveyance device insertable into the powder supply port by installation of the powder container to the image forming apparatus, the powder conveyance device fixedly attached on the image forming apparatus, wherein the inner electrode is on the powder conveyance device.

7. The powder-amount detection device according to claim 6, wherein the powder conveyance device includes a cylindrical guide portion and a powder conveyor housed in the cylindrical guide portion, and the inner electrode is on the cylindrical guide portion.

8. An image forming apparatus comprising:

the powder-amount detection device according to claim 1;

an electrophotographic image forming device; and a powder container housing configured to house the powder container, the powder container configured to supply powder to the electrophotographic image forming device, wherein the powder-amount detection device is in the powder container housing.

9. A powder-amount detection device comprising:

an outer electrode outside a powder container, the powder container being replaceably installable in an image forming apparatus;

an inner electrode inside a powder supply port of the powder container; and a detector configured to apply an electric field between the outer electrode and the inner electrode to detect a capacitance between the outer electrode and the inner electrode, wherein the powder container is cylindrical and the powder supply port is at one axial end of the powder container, and the outer electrode is a cylindrical electrode concentric with an axis of the powder container and is fixedly attached to the image forming apparatus.

10. A powder-amount detection device comprising:

an outer electrode outside a powder container, the powder container being replaceably installable in an image forming apparatus;

an inner electrode inside a powder supply port of the powder container; and a detector configured to apply an electric field between the outer electrode and the inner electrode to detect a capacitance between the outer electrode and the inner electrode, wherein the outer electrode is on at least a portion of a surface of a display label on an outer circumferential surface of the powder container.

11. A powder-amount detection device comprising:

an outer electrode outside a powder container, the powder container being replaceably installable in an image forming apparatus;

an inner electrode inside a powder supply port of the powder container;

a detector configured to apply an electric field between the outer electrode and the inner electrode to detect a capacitance between the outer electrode and the inner electrode; and a powder conveyance device insertable into the powder supply port by installation of the powder container to the image forming apparatus, the powder conveyance device fixedly attached on the image forming apparatus, wherein the inner electrode is on the powder conveyance device.

* * * * *